US009586159B2

(12) United States Patent
Coleman

(10) Patent No.: US 9,586,159 B2
(45) Date of Patent: Mar. 7, 2017

(54) INFLATABLE SOAP BOX DERBY

(71) Applicant: Russell Coleman, Ontario (CA)

(72) Inventor: Russell Coleman, Ontario (CA)

( * ) Notice: Subject to any disclaimer, the term of this patent is extended or adjusted under 35 U.S.C. 154(b) by 0 days.

(21) Appl. No.: 14/231,177

(22) Filed: Mar. 31, 2014

(65) Prior Publication Data

US 2015/0273353 A1 Oct. 1, 2015

(51) Int. Cl.
*A63K 1/00* (2006.01)
*A63H 18/02* (2006.01)

(52) U.S. Cl.
CPC ..... *A63K 1/00* (2013.01); *A63H 18/02* (2013.01)

(58) Field of Classification Search
CPC ..... E04H 15/22; A63K 1/00
See application file for complete search history.

(56) References Cited

U.S. PATENT DOCUMENTS

| | | | | |
|---|---|---|---|---|
| 577,549 | A * | 2/1897 | Griffiths | 104/63 |
| 7,373,888 | B1 * | 5/2008 | Namanny | A63G 31/04 104/60 |
| 9,051,023 | B2 * | 6/2015 | White | |
| 2003/0140815 | A1 * | 7/2003 | Norbury | A63G 25/00 104/53 |
| 2012/0129618 | A1 * | 5/2012 | Gray | 472/134 |

* cited by examiner

*Primary Examiner* — Michael Dennis
(74) *Attorney, Agent, or Firm* — Knobbe, Martens, Olson & Bear, LLP

(57) ABSTRACT

A portable inflatable race track comprising a base, at least one wall, and a race surface, wherein the base is at least partially inflatable from a collapsed position to an inflated position, the race surface is inclined relative to horizontal and includes at least one lane configured to accept a vehicle comprising wheels, wherein at least gravity causes the vehicle to travel down the race surface. The race track may include a starting section, a sloped section, a finish section, and a stopping section. The race track may be configured to allow two or more vehicles to simultaneously race down the race surface.

17 Claims, 11 Drawing Sheets

INFLATABLE SOAP BOX DERBY

TECHNICAL FIELD

The present technology relates to inflatable recreational structures and equipment.

DESCRIPTION OF THE RELATED TECHNOLOGY

Various types of recreational play structures are available to entertain children and adults. Inflatable playhouses, for example, have become very popular in recent years. For many of these inflatable structures, the primary means for providing entertainment is for children and adults to either bounce on air inflated mattresses or to slide down the inflated mattresses. Some inflatable structures incorporate water or inflatable balls to further entertain children and adults.

SUMMARY

The systems, methods and devices described herein have innovative aspects, no single one of which is indispensable or solely responsible for their desirable attributes. Without limiting the scope of the claims, some of the advantageous features will now be summarized.

One aspect of the present invention is the realization that current inflatable recreational structures lack additional elements which add to the entertainment value of the inflatable recreational structures. Thus, there exists a need for an inflatable recreational structure, which children and adults can utilize as a portable inflatable race track.

One non-limiting embodiment of a portable race course comprises a base and a race surface, wherein the base is at least partially inflatable from a collapsed position to an inflated position, the race surface is configured to be inclined relative to horizontal and includes at least one lane configured to receive a vehicle comprising wheels, and wherein the race course is configured such that at least gravity causes the vehicle to accelerate down the race surface. The race course may further comprise a guiding member that comprises a protrusion extending upwards from the race surface. The guiding member may be substantially parallel to at least one lane of the race surface. The guiding member may extend along a majority of the length of the lane. The lane may comprise two guiding members, and the race surface may comprise two lanes. The race course may comprise a plurality of inflatable segments configured to be temporarily connected together. Each inflatable segment may comprise apertures configured to accept a binding device, which may be an elastic cord. The inflatable segments may further comprise a portion of a hook and loop system configured to temporarily connect at least two of the inflatable segments together. The race course may be configured to attach to a second race course. The race course comprises at least two vehicles and a launch mechanism configured to assist the vehicles in starting substantially simultaneously. The race course may also include a deceleration portion configured to decelerate a vehicle that has reached the end of the race surface. The deceleration portion may be angled relative to the race surface, or may comprise a wall configured to limit the distance a vehicle may travel. The track may comprise a lane that is configured to guide vehicles to a beginning of the track.

In another non-limiting embodiment, a race course system may comprise a base, at least one wall, a race surface, and a vehicle, wherein the vehicle may comprise at least three wheels, four wheels, and/or a steering system, and may be at least partially inflatable. The vehicle may be configured to accept a driver.

BRIEF DESCRIPTION OF THE DRAWINGS

The above-mentioned aspects, as well as other features, aspects, and advantages of the present technology will now be described in connection with various embodiments, with reference to the accompanying drawings. The illustrated embodiments, however, are merely examples and are not intended to be limiting. Like reference numbers and designations in the various drawings indicate like elements.

DETAILED DESCRIPTION

Figure 1:
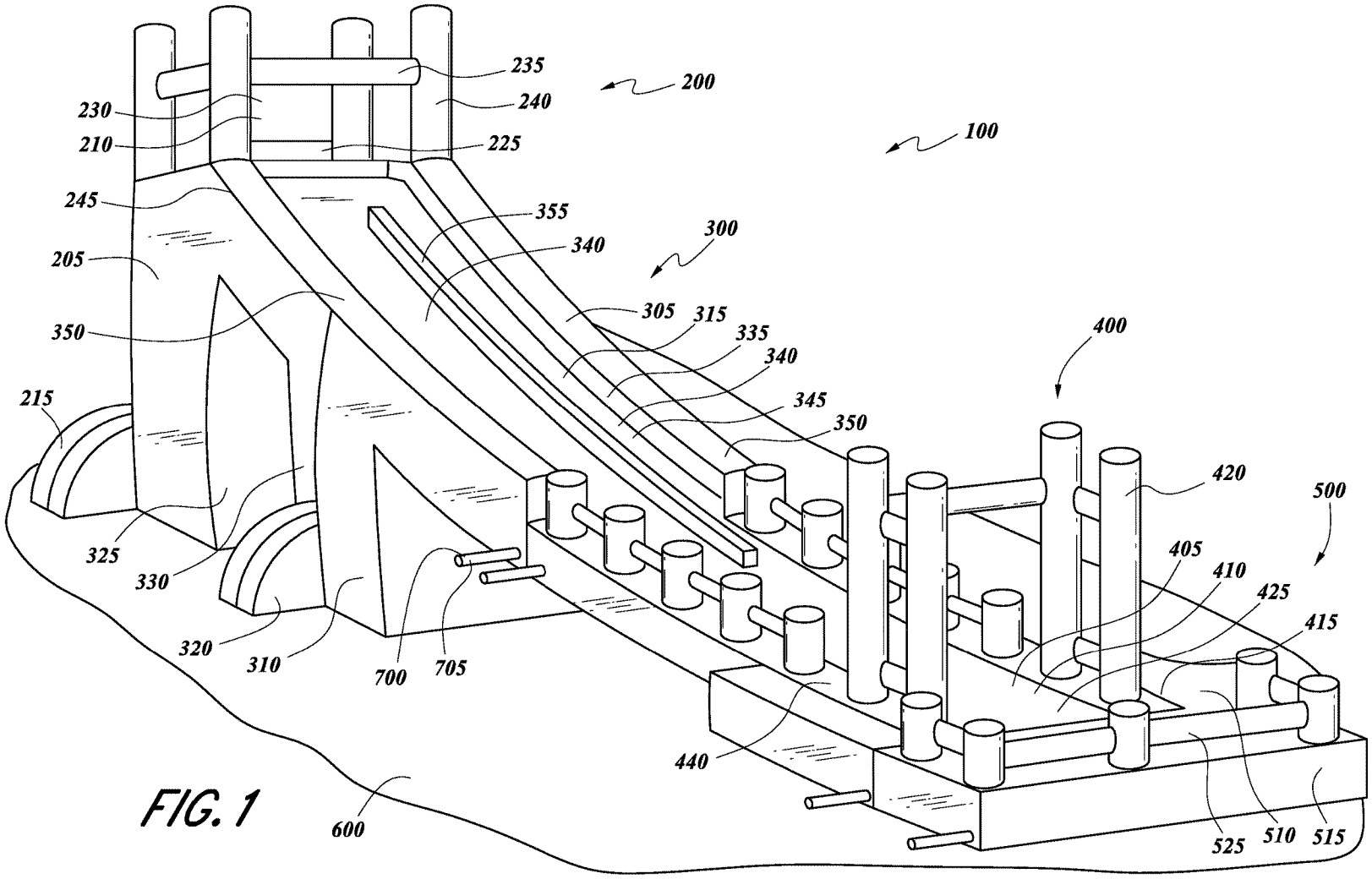
FIG. 1 illustrates a perspective view of an embodiment of an inflatable race track.
Figure 2:
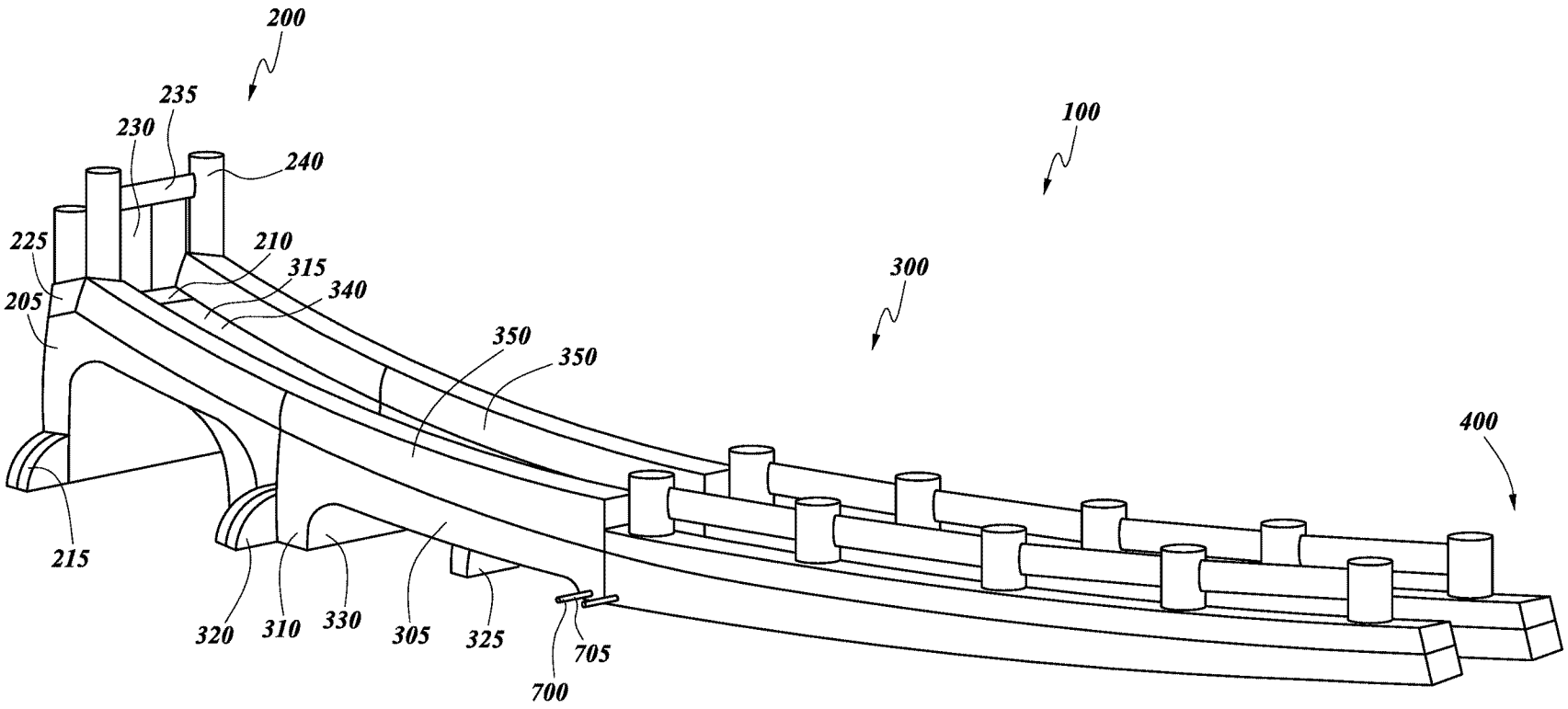
FIG. 2 illustrates a side view of an embodiment of an inflatable race track.
Figure 3:
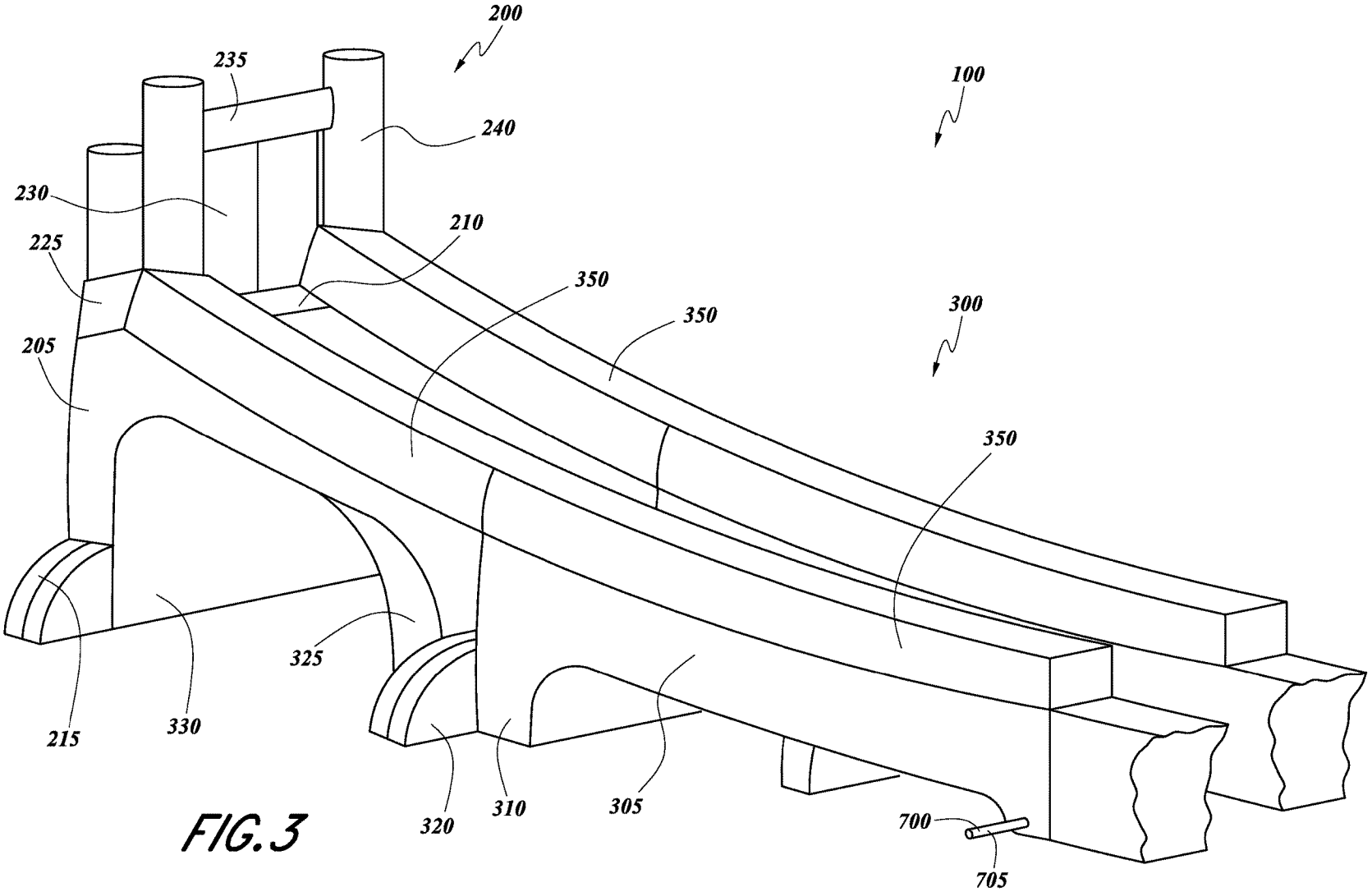
FIG. 3 illustrates a side view of an embodiment of an inflatable race track.
Figure 4:
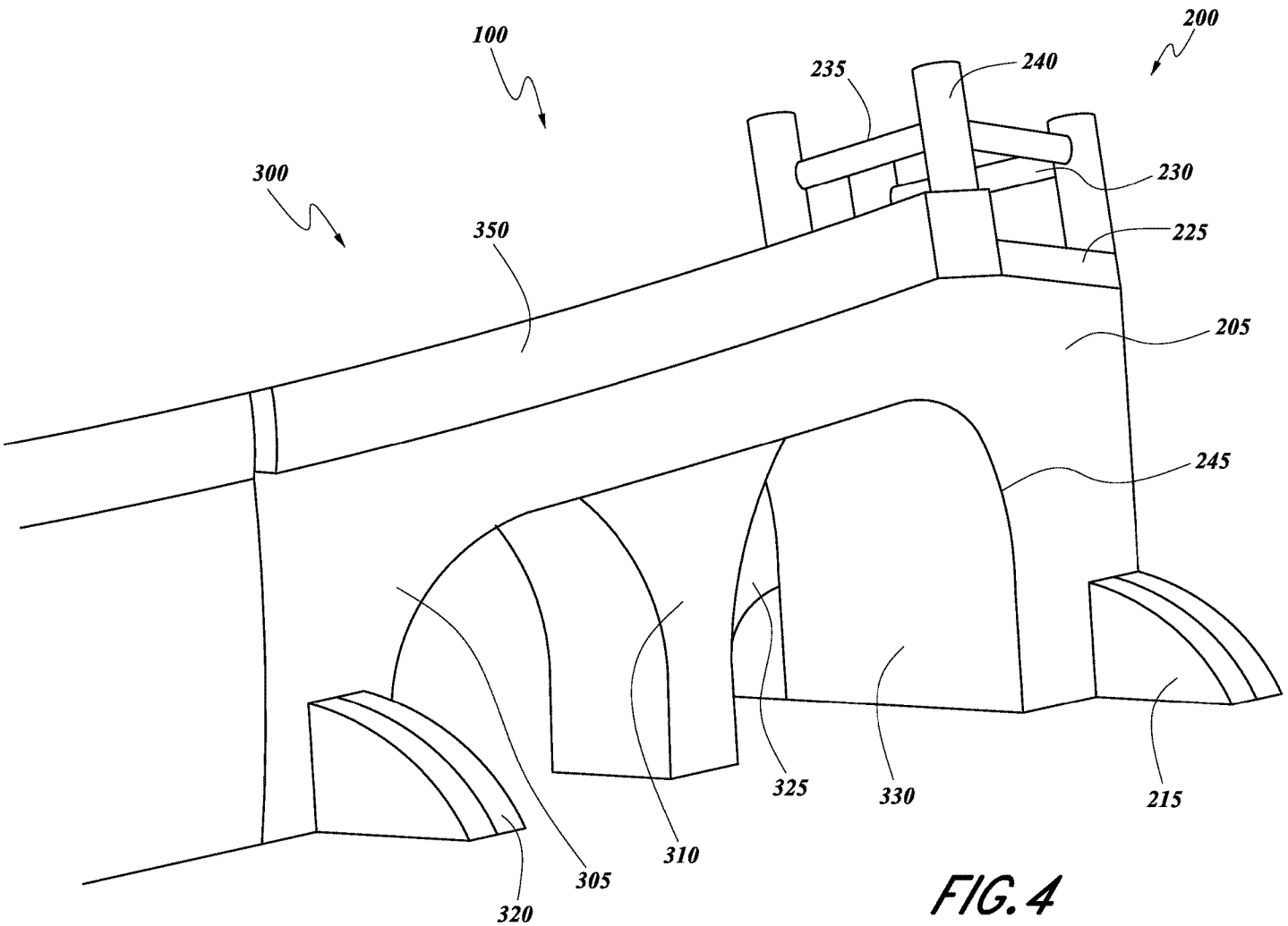
FIG. 4 illustrates a side view of an embodiment of a starting section and a sloped section.
Figure 5:
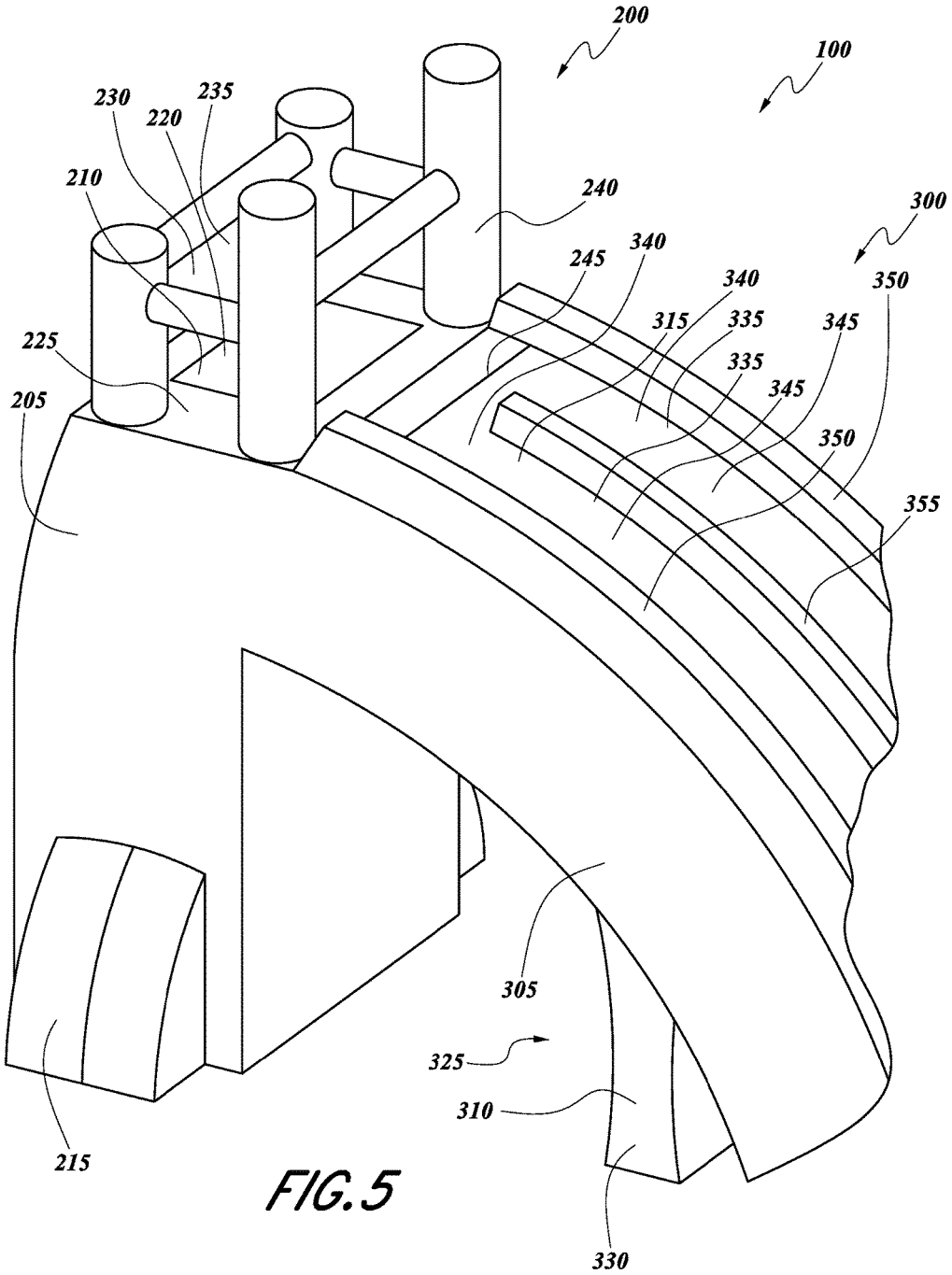
FIG. 5 illustrates a perspective view of an embodiment of a starting section and a sloped section.

In the following detailed description, reference is made to the accompanying drawings, which form a part of the present disclosure. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and form part of this disclosure. For example, a system or device may be implemented or a method may be practiced using any number of the aspects set forth herein. In addition, such a system or device may be implemented or such a method may be practiced using other structure, functionality, or structure and functionality in addition to or other than one or more of the aspects set forth herein. Alterations and further modifications of the inventive features illustrated herein, and additional applications of the principles of the inventions as illustrated herein, which would occur to one skilled in the art and having possession of this disclosure, are to be considered within the scope of the invention.

Descriptions of unnecessary parts or elements may be omitted for clarity and conciseness, and like reference numerals refer to like elements throughout. In the drawings, the size and thickness of layers and regions may be exaggerated for clarity and convenience.

Features of the present disclosure will become more fully apparent from the following description and appended claims, taken in conjunction with the accompanying drawings. It will be understood these drawings depict only certain embodiments in accordance with the disclosure and, therefore, are not to be considered limiting of its scope; the disclosure will be described with additional specificity and detail through use of the accompanying drawings. An apparatus, system or method according to some of the described embodiments can have several aspects, no single one of which necessarily is solely responsible for the desirable attributes of the apparatus, system or method. After considering this discussion, and particularly after reading the section entitled "Detailed Description" one will understand how illustrated features serve to explain certain principles of the present disclosure.

As shown in FIG. 1, in some embodiments, a portable inflatable race track 100 may comprise one or more inflatable segments. Each segment may be several feet high, several feet wide, and several feet long. The segments may be attachable or otherwise capable of being temporarily coupled together. The race track 100 may comprise multiple sections, including for example, a starting section 200, a sloped section 300, a finish section 400, and a stopping section 500. At least part of the starting section 200 may be elevated above some or all of the rest of the race track 100. The sloped section 300 may generally slope downward in the direction in which a patron may travel. The finish section 400 may be configured to allow a patron to finish any race in which they are participating. In the stopping section 500, the patron may slow down and/or stop the vehicle 800 they are driving. The race track 100 may generally be supported by the ground, but may also be supported by any other suitably stable structure, such as a platform. The ground may be level, sloped or otherwise variably contoured. The sections described herein are general approximations and may overlap. For instance, a portion of the sloped section 300 may also comprise a portion of the finish section 400. The sections are not necessarily exclusive and not all parts of the race track 100 need be categorized into one of the named sections. To use the track 100, it may be inflated and erected upon the ground. Two or more tracks 100 may be placed adjacent one another such that more patrons may use the tracks at a single time.

To assemble the track 100, one may generally begin by placing a ground layer 600 upon the ground on which the track 100 is to be erected. The track 100 may then be placed upon the ground layer 600 and inflated. Alternatively, the track 100 may be placed directly on the ground or on another suitably stable structure. Each segment may be inflated one at a time or a plurality may be inflated at once. The segments may be joined together using a one or more of the following: rope, hook and loop tape (e.g., Velcro™), clips, straps, or buckles. Other methods of attachment may be suitable. Once all segments have been inflated and suitably joined, the track 100 may be ready for use by a patron. The steps to inflate a track 100 need not be performed in any particular order and the scope of the invention is not limited by the order in which the assembly steps are performed.

A patron may use the track 100 by arriving at the top of the track 100 with a suitable vehicle. A suitable vehicle 800 may include a soap box derby car or other vehicle 800 on which the patron may descend down the track 100 towards the bottom. More than one driving lane 340 may be present on a track 100, depending on the track's configuration. On a track 100 that has more than one lane 340, more than one patron may descend down the track 100 at a single time. In some instances, two or more patrons may begin descending down the track 100 simultaneously and race to the bottom. The first patron to the bottom may be considered the winner and may win a prize or other reward. Patrons suitable for using the track 100 may be children, adults, families, etc. The track 100 may be used by patrons in a variety of events and contexts. For instance, the track 100 may be assembled and utilized at carnivals, fairs, parties, corporate events, amusement parks, etc. Reasons for using the track 100 may vary, and may include personal enjoyment, competitions, or some other reason.

After patrons have finished using the track 100 and the owner or operator wishes to disassemble the track 100, each segment of the track 100 may generally be deflated and detached from one another. The at least partially deflated segments may then be stored or transported.

Starting Section

As shown in FIGS. 1-5, 9 and 10, in some embodiments, the starting section 200 may comprise an inflatable segment 205 and a landing 210. The starting section 200 may rise several feet above the ground. The inflatable segment 205 may comprise lateral supports 215. Lateral supports 215 may be integral to the inflatable segment 205 or may be attached separately. The lateral supports 215 may also be inflatable, or may be otherwise stable enough to help the inflatable segment 205 remain upright. In some embodiments, the inflatable segment 205 is sufficiently stable that lateral supports 215 are not necessary. Lateral supports 215 may include components that are positioned adjacent the base of the inflatable segment 205 and assist in keeping the inflatable segment 205 upright or help prevent the inflatable segment 205 from moving along the ground or lifting up into the air.

Portions of the starting section 200 may comprise eyelets, tabs, or tie downs (not shown) that can accept a rope, strap, or other devices that may help by keeping the section from moving. One end of a rope may be tied or attached to a tie down, with the other end of the rope being secured to a stable structure. The rope and tie down may prevent or discourage the starting section 200 from moving laterally or vertically, twisting, or otherwise being displaced. The tie downs and/or the lateral supports 215 may help prevent movement of the starting section 200 against the force of wind. The tie downs may be located at least several feet above the ground so that any tension applied to a rope attached to a tie down may apply a downward force to the starting section 200 against the ground. However, even a tie down that is located at the very bottom of the starting section 200 may still be beneficial, and may still help prevent unwanted movement.

In some embodiments, the upper end of the starting section 200 may comprise a landing 210 that is generally configured to accommodate one or more patrons before they begin their descent down the track 100, or an operator. The landing floor 220 may be several feet wide and several feet long and may be generally level. The sides of the landing 210 may comprise walls 225 that may extend several feet into the air. Since the landing 210 may be many feet above the surface of the ground, safety and other considerations may influence the style and dimensions of the walls 225. The walls 225 may comprise one or more window sections 230 that may comprise netting, plastic or other transparent or translucent material (not shown) such that a patron positioned on the landing 210 may be able to see laterally and away from the track 100. The landing 210 may comprise a roof or ceiling 235 or other structure that is above a patron standing on the landing 210. The roof 235 may serve the function of protection from elements, safety, structure, or another function. The roof 235 may comprise a transparent or translucent material similar to any windows present, or may comprise a more opaque material through which light generally does not travel. The landing 210 may serve the purpose of allowing one or more patrons the opportunity and space to wait before he/she begins their descent down the track 100. The landing 210 may also provide a suitable location for an operator to be located in order to serve a function associated with the track 100. Functions associated with the track 100 may be related to relaying information, safety, or mechanical or electrical operation of some feature of the track 100.

In some embodiments, approximately three sides of the landing 210 may comprise a wall 225 and/or window 230, with the fourth side being generally exposed to other parts of the track 100. The landing 210 may be adjacent or proximate the top of the sloped section 300. The top of the sloped section 300 may be accessible from the landing 210, and the landing 210 may accessible from the top of the sloped section 300. In some embodiments, a patron may gain access to the landing 210 by walking up the length of the sloped section 300. In some embodiments, a patron may gain access to the landing 210 by some other route, including, but not limited to, from below, above, or one of the sides of the landing 210. For instance, a structure with stairs (not shown) may be placed adjacent the starting section 200 such that a patron could ascend the stairs and then access the landing 210 directly, without the need to travel the length of the sloped section 300. The vehicles 800 on which the patrons ride down the sloped section 300 may be pushed up the length of the sloped section 300 to arrive at the landing 210. Other methods may be employed to position the vehicles at the landing 210. For instance, the cars may be pulled up the sloped section 300, or some other part of the race track 100, to deliver them to the landing 210 independent of a patron. The patron may thus be able to arrive at the landing 210 independently of the vehicle.

In some embodiments, the track 100 comprises a pulling device that is configured to pull one or more vehicles up to the landing 210; the pulling device may comprise a winch 245. The winch 245 may be configured to be permanently or temporarily secured at or near the top of the sloped section 300 and may be anchored to one or more locations at the starting section 200. In some embodiments, the track 100 comprises a lane that is at least primarily dedicated to pulling vehicles up to the landing 210. Or, the vehicles may be pulled up one or more of the lanes that are used for racing. The winch 245 may be generally aligned with a lane at least primarily dedicated to pulling vehicles (see FIG. 9), or the winch 245 may be located near one or more lanes such that vehicles can be pulled up the one or more lanes (see FIG. 10). The pulling device may comprise components that help direct the cable of a winch 245 to the correct location within the lane. The starting section 200 may comprise connection devices (not shown), such as d-rings, that may be anchored or secured to part of the starting section 200. The connection devices may be used for a variety of purposes, which may include: anchoring a pulling device such as a winch 245; securing a patron or operator at or near the location of the connection device; or, at least temporarily securing a vehicle 800 near the starting section 200. Other uses for the connection devices may be available as well.

The landing 210 may additionally be augmented with poles 240 or decorations. The poles 240 may be inflatable and may be in fluid communication with other parts of the starting section 200. Inflating the starting section 200 may also inflate any of the poles 240 present. Other decorations may be present. Decorations (not shown) may include inflatable augmentations, such as cars, cones, or flags, or may include two-dimensional designs that are generally attached to or part of the starting section 200. Flags, streamers, or other objects may be attached to various parts of the starting section 200 for either functional or decorative purposes.

The starting section 200 may comprise various materials including rubber, plastic, vinyl, nylon, PVC, etc. Seams of the starting section 200 may be sewn, glued, or welded together, or otherwise attached. In some embodiments, parts of the starting section 200 may be integrally formed, reducing the need for seams. Parts of the starting section 200 may comprise metal or plastics, such as any tie downs, connectors, etc.

Variations may be made to the starting section 200 and the landing 210 for at least stylistic or functional reasons. The size of the landing 210 may vary. A larger landing 210 may allow for more room for an operator and/or patrons. A smaller landing 210 may be easier to support by the remainder of the starting section 200. Other safety measures may be employed, such as ropes, netting, walls, etc. Some embodiments may allow for access to the landing 210 and other parts of the starting section 200 in ways other than via the sloped section 300.

Some variations of the race track 100 may include a starting gate feature, or some mechanism capable of synchronizing the start of a race between multiple patrons. For instance, two or more patrons may participate in a race and compete against each other. In order to determine who the winner is, it may be advantageous to have patrons begin their descent down the sloped section 300 at the same time. A mechanism that generally synchronizes the start of the race may be employed in a variety of ways. As a non-limiting example, a mechanical device may be part of the starting section 200, which may physically prevent the patrons and their associated vehicles from beginning their descent until a specified time. At the specified time, a physical mechanism may be triggered, which releases the vehicles and allows them to move forward. In another non-limiting example, the mechanism may be electronic and may employ electronics to physically prevent the vehicles from moving before the specified time. In another non-limiting example, the synchronization feature may not physically restrain the patron from beginning their descent, but may merely start a timer or other electronic feature, and may additionally indicate whether the patron has crossed the starting line before the specified time. In any of these non-limiting examples, the mechanism may be triggered locally or remotely and the triggering of the mechanism may trigger other mechanisms as well. For instance, any of the named mechanisms may be operated by a person located on the landing 210, located near the finish, or located in some other location.

Sloped Section

As shown in FIGS. 1-6, 9, and 10, in some embodiments, the sloped section 300 may generally comprise an inflatable segment 305 that includes supporting structures 310 as well as a floor section 315. Different parts of the sloped section 300 may rise several feet above the ground. The supporting structure 310 may support the floor section 315 and may be augmented by lateral supports 320. Lateral supports 320 may be integral to the supporting structures 310 or may be connectable to the supporting structures 310. The lateral supports 320 may be inflatable, or may be otherwise stable enough to help the supporting structure 310 remain upright.

In some embodiments, the inflatable segment 305 is sufficiently stable that lateral supports 320 are not necessary. Lateral supports 320 may include components that are positioned adjacent the base of the supporting structure 310 and assist in keeping the supporting structure 310 upright or help prevent the supporting structure 310 from moving along the ground, lifting up into the air, or otherwise undesirably displacing.

Portions of the sloped section 300 may comprise eyelets, tabs, or tie downs (not shown) that can accept a rope, strap, or other device that may help by keeping the section from moving. One end of a rope may be tied or attached to a tie down, with the other end of the rope being secured to a stable structure. The rope and tie down may prevent or discourage the sloped section 300 from moving laterally or vertically, twisting, or otherwise being displaced. The tie downs and/or the lateral supports 320 may help prevent movement of the sloped section 300 against the force of wind. The tie downs may be located several feet above the ground so that any tension applied to a rope attached to a tie down may apply a downward force to the sloped section 300. However, even a tie down that is located near the bottom of the sloped section 300 may still be beneficial.

In some embodiments, the sloped section 300 defines arches 325 that pass transversely through the sloped section 300. The arches 325 may serve both functional and/or decorative functions. In some embodiments, the arches 325 allow air to pass beneath the sloped section 300 in order to prevent wind from moving or knocking over the sloped section 300 or other parts of the track 100. Additionally, arches 325 may allow people or objects to more easily move from one side of the sloped section 300 to the other. Other benefits of arches 325 may be present as well. The inflatable segments 330 adjacent the arches may support the floor section 315 that is suspended above the ground. In some embodiments, the sloped section 300 defines no arches 325.

The floor section 315 may generally extend from the starting section 200 to the finish section 400, and in some embodiments may extend further. Beginning at the starting section 200, the floor 315 may be generally sloped downwards, away from the starting section 200. The slope of the floor 315 may not be constant throughout the length of the floor 315, but instead may vary. In some embodiments, parts of the floor 315 may not be sloped downward, but may instead be generally horizontal or may have a negative slope that slopes backward, towards the starting section 200. The variation in slope along the length of the floor 315 may be beneficial as it may allow different experiences for the user, depending on the profile of the floor 315. For instance, a user may find it enjoyable and/or challenging to travel along a track 100 that is steep at the beginning, but then generally less steep later in the track 100. Or, the user may find it enjoyable and/or challenging if the track 100 begins steep, then levels out, then has a negative slope to decrease the user's speed, then horizontal again, and then finish with a steeper slope towards the finish section 400. Different combinations of slope of the floor 315 may result in a unique user experience that may be customized depending on at least the audience and patronage of the track 100.

The floor 315 of the sloped section 300 may provide a surface on which a user's vehicle 800 can travel. The surface of the floor 315 may be grippy, slick, bumpy, smooth, or have another surface characteristic that best provides for a positive user experience. In some embodiments the surface of the floor 315 may be altered in order to allow patrons to walk along the floor 315 in order to arrive at the starting section 200. Stairs, steps, or another feature that provides the same or similar benefits may be present in order to best accommodate a patron traveling up the sloped section 300. In some embodiments, the outer edges 335 of the lane 340 may be of a first texture, while the middle part 345 of the lane 340 may be of a second texture. A middle portion 345 that provides traction to a patron ascending the track 100 may be beneficial as this configuration may be safer. An outer portion 335 of the lane 340 with a first texture may be beneficial as it may be less likely that a patron will need this area on which to walk. Instead, this outer portion 335 may be optimized for vehicle travel, which may include the floor 315 being smooth.

In some embodiments, a second surface (not shown) is applied over at least part of the floor 315 of one or more lanes 340. The second surface may comprise plywood, or other sufficiently rigid material that is generally planar. The second surface may also comprise a cover over the plywood, such as vinyl. The second surface may provide a more suitable surface on which the vehicles 800 may begin or continue their race.

The sloped section 300 may comprise walls 350 and/or dividers 355 that generally extend upward from the floor 315, and may be present along some, much, or all of the length of the sloped section 300. Walls 350 may be located along the sides of the floor 315 and may be between several inches to several feet high. Walls 350 may be beneficial as they may provide some measure of safety and may prevent a patron from falling off the side of the sloped section 300 either during their ascent to the landing 210 or during their descent during racing. The walls 350 may be inflatable similar to other parts of the track 100, or may comprise other forms. In some embodiments, the walls 350 may comprise a solid, yet inflatable, section, close to where the wall 350 meets the floor 315, but then comprise a more open configuration higher up on the wall 350. In such embodiments, the wall 350 may provide safety for the patrons, but may also allow patrons to see through parts of the wall 350. Additionally, variations of the walls 350 may provide decorative features. The sloped section 300 may define a break in the divider 355, that may be configured to allow vehicles 800 to be more easily transported from one location of the sloped section 300 to another. The vehicles may be transported from a lane 340 dedicated to transporting vehicles to the starting section 200, or from a first lane 340 to a second lane 340.

In some embodiments, a sloped section 300 may be configured to allow multiple patrons to travel down the sloped section 300 at the same time. For embodiments that allow two patrons to simultaneously descend down the track 100, a divider 355 may be present. The divider 355 may physically separate a portion of a first patron's lane 340 from a portion of a second patron's lane 340. The divider 355 may be inflatable similar to other parts of the track 100, or may comprise a different structure. The divider 355 may be integral to the track 100, or may be attached before or after inflation. In some embodiments, the divider 355 may be several inches to about a foot wide and approximately a foot tall. The divider 355 may be wider or narrower, taller or shorter, and still provide the same or similar benefit. A divider 355 may be beneficial as it may prevent a first patron from crashing into a second patron during a race, and thus be safer for the patrons.

In some embodiments, the sloped section 300 may comprise decorations that may augment a patron's experience. Decorations may include inflatable portions, or may include two-dimensional designs. Some embodiments may comprise arches or portions of a roof that extend over the sloped section 300 from one side of the floor to the other. An arch or a roof may provide protection from the elements or may provide some other functional benefit. Or, an arch or roof may also be decorative.

In some embodiments, the sloped section 300 is generally straight, with the majority of the sloped section 300 generally aligned with a vertical plane that extends from the starting section 200 to the finish section 400. In some embodiments, the sloped section 300 may deviate from this vertical plane and may be angled laterally to either or both sides. In such embodiments, it may be necessary for a patron to steer the vehicle 800 one way or the other in order to successfully descend from the starting section 200 to the finish section 400. Having the sloped section 300 deviate from the vertical plane may provide a unique user experience and may be enjoyable and/or challenging. In some embodiments, a sloped section 300 that is generally aligned with a vertical plane may be preferable. Whether to have a sloped section 300 that is generally straight or deviates right or left may be influenced by at least user or manufacturer preference.

In some embodiments, at least part of the sloped section 300 and the starting section 200 are integrated into the same inflatable segment such that inflating the starting section 200 inflates at least part of the sloped section 300. In some embodiments, at least a portion of the starting section 200 may be attachable to the sloped section 300. In some embodiments, the sloped section 300 comprises one or more inflatable segments that may be individually inflated and coupled to one another. Since patrons may start from the landing 210 and descend down the sloped section 300, it may be preferable for there to be minimal gap between the starting section 200 and the sloped section 300. Various processes and components may be employed in order to attach the different inflatable segments. Similarly, if the sloped section 300 comprises multiple inflatable segments, it may be desirable for there to be a minimal gap between the inflatable segments that make up the sloped section 300. In some embodiments, both the starting section 200 and the sloped section 300 may comprise tabs and/or eyelets. One method of attaching the inflatable segments may comprise positioning the tabs and/or eyelets such that a rope or elastic cord may be threaded through the tabs or eyelets and then secured. This method may, in part, resemble lacing a shoe; however the exact path of the rope may not be as important as whether or not the pieces are adequately joined. After the sections are attached using tabs and a rope, one may utilize hook and loop tape (e.g., Velcro™) to connect the sections as well. In some embodiments, flaps comprising hook and loop tape can be folded over the lace/loop system to secure the sections together. The flaps may be alternating, such that a flap extending from a first inflatable segment to a second inflatable segment may be adjacent a flap extending from the second inflatable segment to the first inflatable segment. Using flaps in addition to the rope or elastic may also provide a smoother transition between the segments and may be more secure.

In some embodiments, at least part of the starting section 200 and at least part of the sloped section 300 may be part of the same inflatable segment. In these embodiments, the starting section 200 may be already connected to at least part of the sloped section 300 and inflating the starting section 200 may also inflate at least part of the sloped section 300. Such a configuration may be advantageous in that it may result in a more stable structure and/or may be more easily inflated, deflated, or transported. Since the sloped section 300 may comprise one or more inflatable segment, it may be necessary to attach several inflatable segments. Attachment of the one or more inflatable segments may be accomplished using similar methods as described above.

In some embodiments, the sloped section 300 may be used by a patron by starting at the top of the sloped section 300 or at the landing 210, and descending down the floor 315, while operating a vehicle 800. The vehicle 800 may include a soap box derby car, a car similar to a soap box derby car, or some other mode of transportation down the sloped floor 315. An object of the race may be to attempt to get from the landing 210 to the finish section 400 as quickly as possible and to arrive faster than other patrons competing in that, or another, race. In order to arrive at the finish section 400 quickly, it may be advantageous for the patron to steer the vehicle 800 and keep it from touching a wall 350 or a divider 355. Touching a wall 350 or divider 355 as the vehicle 800 travels down the floor 315 may result in frictional resistance, decreasing the speed of the vehicle 800 and increasing the amount of time it takes for the patron to complete the race. In some embodiments, gravity is the primary or sole accelerating force compelling the vehicle 800 and the patron to increase speed. One consideration of the configuration of the track 100 may be the patron's safety. Different configurations may be safer than others and it may depend, at least in part, on the operator's, owner's, or manufacturer's preference regarding the various dimensions of the track 100. Possible dimensions to consider include, but are not limited to: the slopes of the track 100; the length of the track 100; the width of the lanes 340; the height of the divider 355 and walls 350; the configuration of the vehicles 800; any safety apparel worn by patrons; the configuration of the finish section 400; and the configuration of the stopping section 500. Other considerations may be appropriate depending on the circumstances and context in which the track 100 is operated.

The sloped section 300 may generally comprise various materials, which may include plastic, metal, rubber, vinyl, PVC, nylon, or other suitable materials. The sloped section 300 may comprise a fluid containing portion, which may be substantially surrounded by a protective layer. The protective layer may be more tough and abrasion resistant than other parts of the sloped section 300, including the fluid containing portion. Different parts of the sloped section 300 may be sewn, welded, glued, or otherwise attached in order to create the configuration desired. Different parts of the sloped section 300 may be more prone to damage and thus may be configured differently. For instance, as a non-limiting example, portions of the floor 315 that may frequently contact the moving vehicle 800 may be reinforced in order to decrease the likelihood of puncture or other damage.

In some embodiments, the configuration of the sloped section 300 may comprise variations. For instance, the slope of the floor section 315, as generally measured relative to a horizontal surface, may be varied throughout the length of the sloped section 300. The sloped section 300 may comprise a constant slope all the way down, a different slope depending on the location along the track 100 at which the slope is measured, or horizontal or negatively sloped sections. The slope of the floor 315 may in part be influenced by whether a patron may walk up the floor 315 in order to arrive at the landing 210. If the slope of the floor 315 is too steep in sections, it may be difficult for the patron to use the floor 315 as a walkway. Other considerations may be appropriate. The overall width of each lane 340 may be varied as well, wherein the width of a lane 340 may be constant or variable throughout its length.

In some embodiments, the height of the sloped section 300 above the ground may be varied. Some embodiments may benefit from the beginning of the sloped section 300 being very high above the ground. The higher the beginning of the sloped section 300 is above the ground, the more potential energy the patron has at the beginning of the race, and the faster the patron may be traveling at the end of the race. However, a lower height at the beginning of the sloped section 300 may also be beneficial due to safety or other concerns. The height of the sloped section 300 in the middle of the sloped section 300 may be varied as well and may be influenced, in part, by the desired contour or profile of the sloped section 300. The height of the end of the sloped section 300 may be varied as well. In some embodiments, the height of the sloped section 300 at a point close to the finish section 400 may be right on the ground, or right next to the ground. This configuration may be beneficial in that it may be more stable or may provide easier access for patrons and or operators. Other embodiments may benefit from the height of the sloped section 300 near the finish section 400 to be elevated above the ground level.

As shown in FIGS. 1, 5, 6, 7A, 9, and 10, in some embodiments, there are two lanes 340 per track 100. In these embodiments, the sloped section 300 may comprise a floor 315, two walls 350 on the sides of the floor 315, and a divider 355 between the two lanes 340. Two patrons may operate two separate cars at the same time and may compete against one another head-to-head. In other embodiments, a single vehicle 800 in a lane 340 may be configured to accommodate two or more patrons per vehicle, resulting in four or more patrons competing at the same time. In some embodiments, more than two lanes 340 may be present on a single sloped section 300. For instance, as a non-limiting example shown in FIG. 7B, a sloped section 300 may comprise a floor 315, two walls 350 on the sides of the floor 315, and three dividers 355, which may create four separate lanes 340. Here, four vehicles 800 may be operated at a single time and four patrons may compete against each other simultaneously. Other numbers of lanes 340 per sloped section 300 may be possible and/or desirable. In addition, some embodiments may comprise multiple sloped sections 300 positioned adjacent one other in parallel and create a race track 100 in which four vehicles 800 can be operated in four separate lanes 340 simultaneously. In these embodiments, it may be desirable to have multiple starting sections 200, finish sections 400, and stopping sections 500 as well. In other embodiments, multiple sloped sections 300 may be attachable to a single starting section 200, a single finish section 400, and/or a single stopping section 500. The dimensions and configurations of the various sections may influence how the sections are connected and may use the same or similar methods of attachment as described earlier.

Figure 7A:
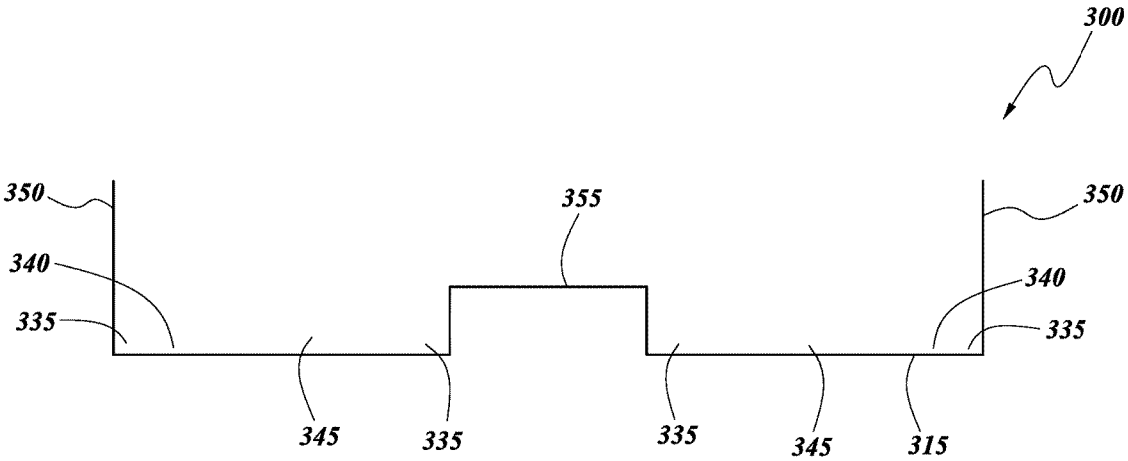
FIGS. 7A-D illustrate various embodiments of a cross-section of a sloped section.
Figure 7B:
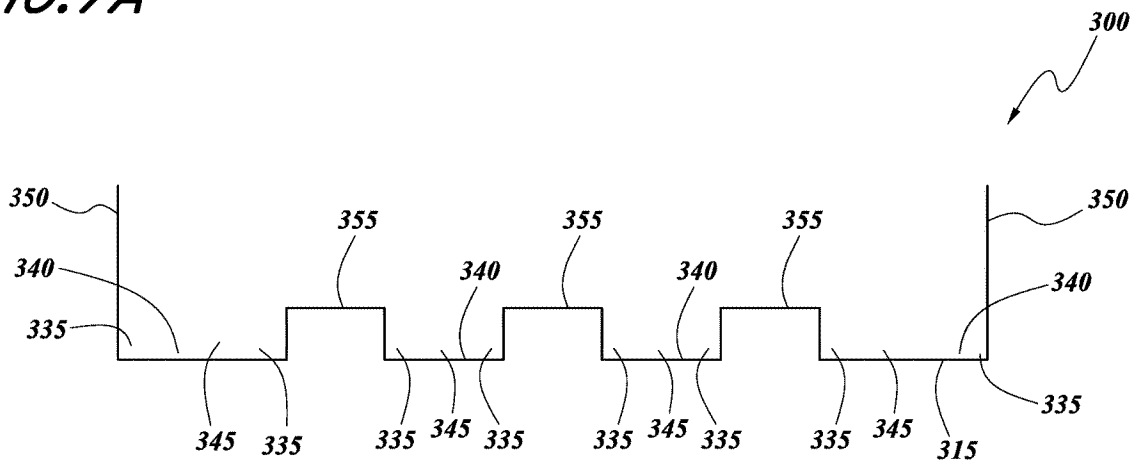
Figure 7C:
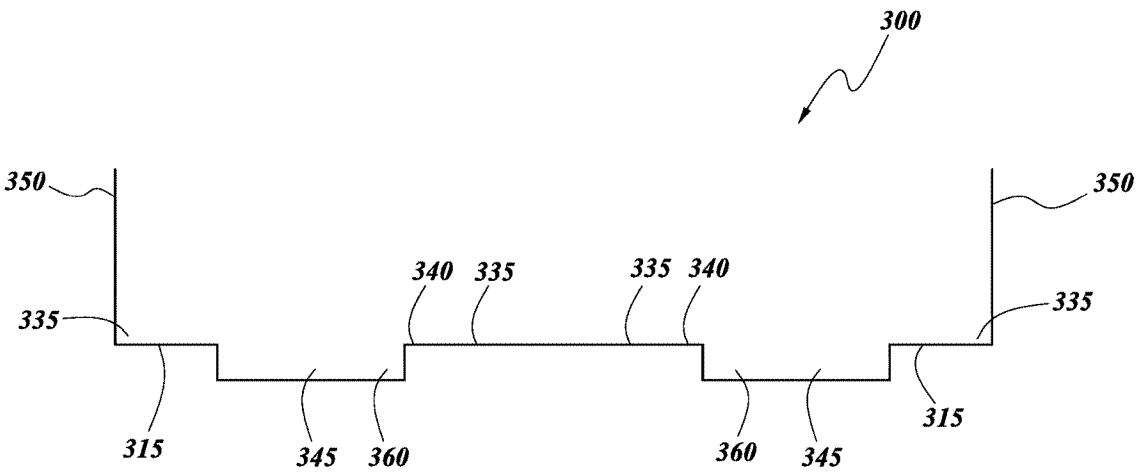
Figure 7D:
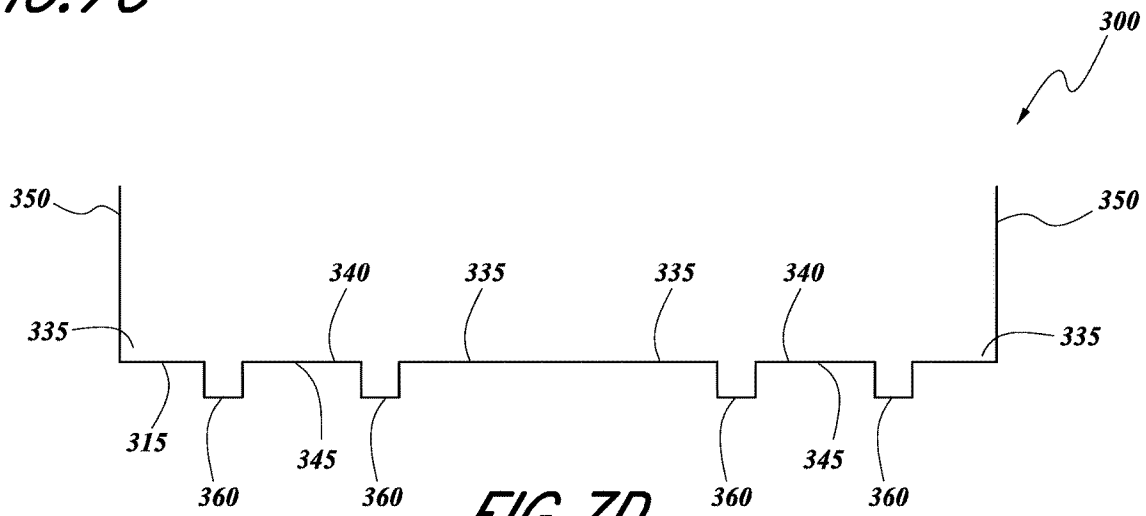

In some embodiments, the style of the lanes 340 and the method of keeping the vehicles 800 separate during use may vary. For instance, as described above and shown in FIG. 7A, a divider 355 may be employed to substantially prevent vehicles 800 from contacting during use. However, other methods may be used to prevent the cars from contacting. As shown in FIG. 7C, in some embodiments, instead of using a floor 315 with a divider 355 between the lanes 340, it may be beneficial or desirable to use no barrier, or a small barrier, but instead provide one or more grooves or slots 360 into which the wheels of a vehicle 800 may travel. A single groove 360 may be disposed in a single lane, along at least part of the length of the floor 315 of the sloped section 300. The wheels of the vehicle 800 may fit into the groove 360 and the groove 360 may be configured to substantially contain the vehicle 800 laterally within a designated area. Thus, it may be unnecessary to have a large physical divider 355 between the lanes 340, and it may be more enjoyable for the patrons to operate a vehicle 800 traveling down the sloped section 300 with little or nothing between their vehicle 800 and their competitor's vehicle. As shown in FIG. 7D, in some embodiments, two or more grooves 360 per lane 340 may be employed. In these embodiments, the grooves 360 may be narrower in width such that the right wheels of the vehicle 800 may be positioned within a first groove 360, and the left wheels of the same vehicle 800 may be positioned within a second groove 360. Similar to embodiments that only use a single groove 360 per lane 340, there may be less or no need to position a divider 355 between the lanes 340, which may result in a more enjoyable experience for the patrons. In other embodiments, various other mechanical or electrical methods or systems may be employed to keep the vehicles 800 in a designated area and prevent contact with a competing vehicle.

Finish Section

Figure 6:
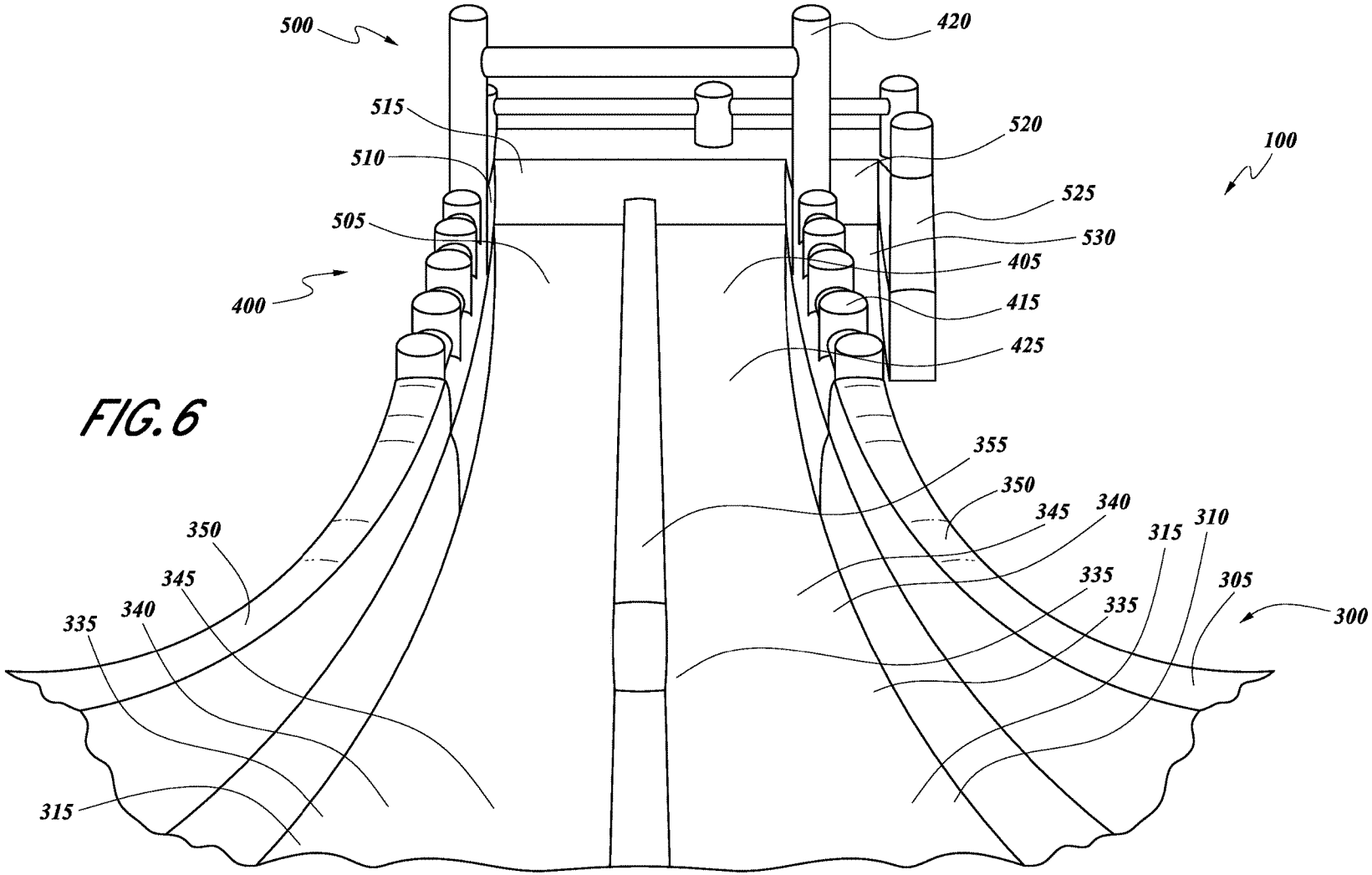
FIG. 6 illustrates an end view of an embodiment of a sloped section, finish section, and stopping section.
Figure 8:
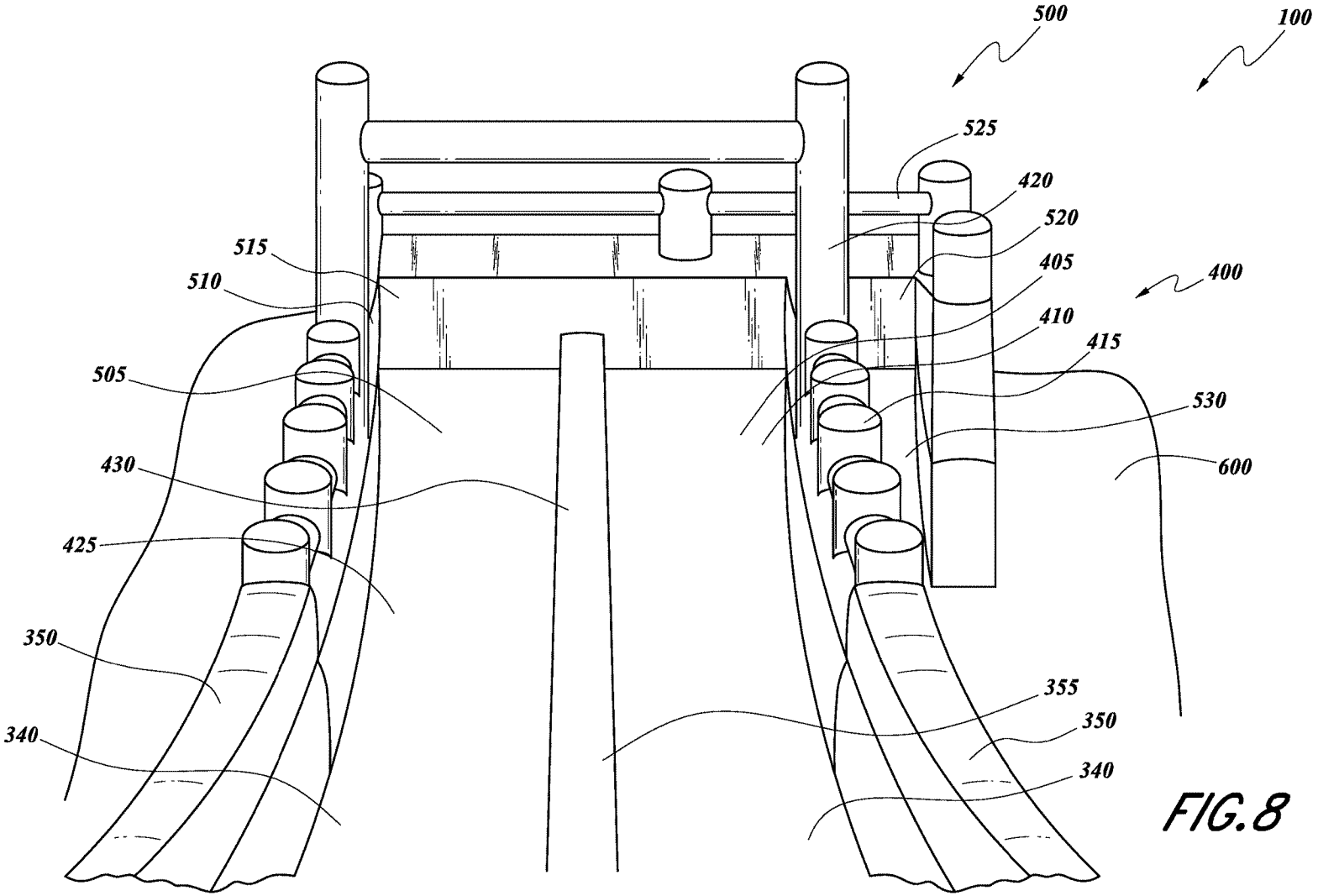
FIG. 8 illustrates an end view of an embodiment of a floor section, finish section, and stopping section.
Figure 9:
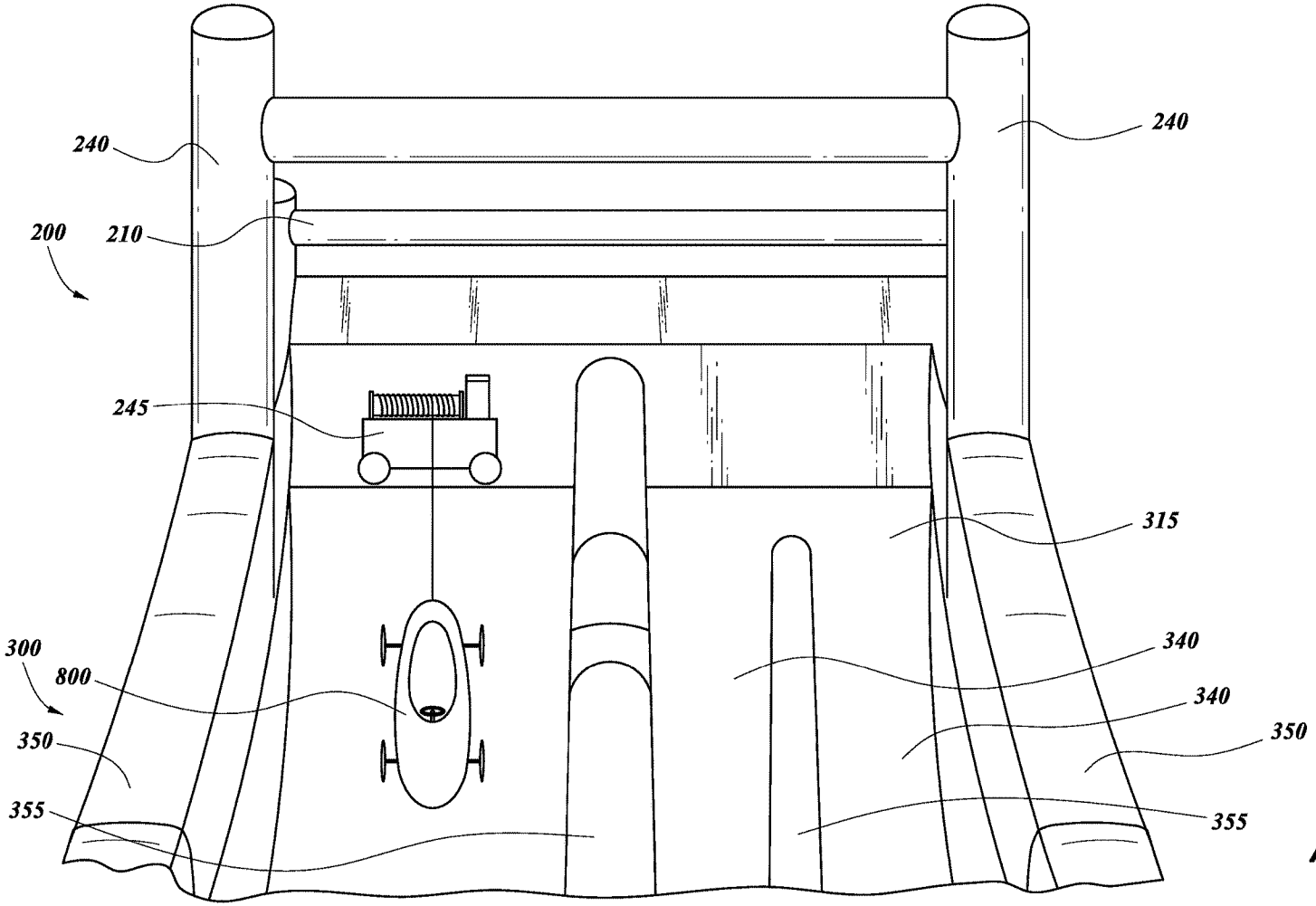
FIG. 9 illustrates an end view of an embodiment of a starting section and sloped section.
Figure 10:
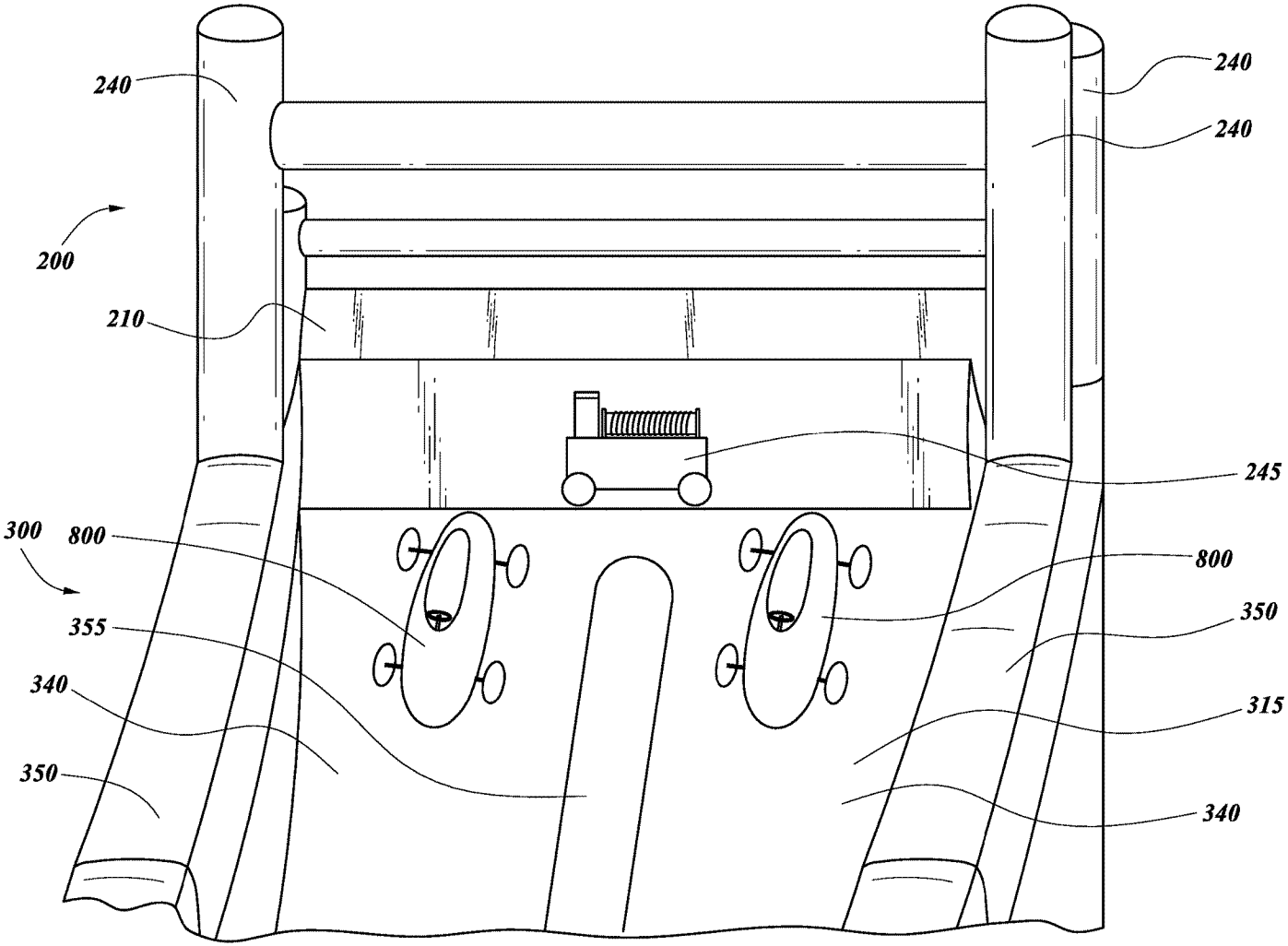
FIG. 10 illustrates and end perspective view of an embodiment of a starting section and sloped section.

As shown in FIGS. 1, 6, and 8, in some embodiments the finish section 400 may be adjacent the end of the sloped section 300 and may be supported by the ground. The finish section 400 may comprise a finish line 405, a floor 410, and walls 415. The finish line 405 may comprise poles 420 or an arch that goes over the finish line 405 area. One purpose of the finish line 405 may be to provide patrons with an end of the track 100 over which the patrons are racing. In some embodiments, a competitive race between two or more patrons may end when one of the patrons crosses the finish line 405. The patron who crosses the finish line 405 first may be considered the winner.

Inflatable segments used in the finish section 400 and the sloped section 300 may be connected utilizing methods similar to those described above. In some embodiments, at least part of the sloped section 300 and at least part of the finish section 400 may be integrated into the same inflatable segment such that inflating at least part of one section inflates at least part of the other section. In some embodiments, at least a portion of the finish section 400 may be attached or coupled to the sloped section 300. Since patrons may descend down the sloped section 300 and cross the finish line 405 traveling at a moderate velocity, it may be preferable for there to be minimal gap between the finish section 400 and the sloped section 300. Various processes and systems may be employed to attach the various inflatable segments. In some embodiments, parts of both a first and second inflatable segment may comprise tabs and/or eyelets. One method of attaching the first inflatable segment to the second inflatable segment may comprise positioning the tabs and/or eyelets such that a rope or elastic cord may be threaded through the tabs or eyelets and then tied. This method may, in part, resemble lacing a shoe; however, the exact path of the rope may not be as important as whether or not the segments are adequately joined. After the segments are attached using tabs and a rope, one may utilize hook and loop tape (e.g., Velcro™) to connect the segments as well. In some embodiments, flaps comprising hook and loop tape can be folded over the lace/loop system to lock the segments together. The flaps may be alternating, such that a flap extending from the first inflatable segment to the second inflatable segment may be adjacent a flap extending from second inflatable segment to the first inflatable segment. Using flaps in addition to the rope or elastic may also provide a smoother transition between the segments.

In some embodiments, one or more patrons may descend down the sloped section 300 and may gain speed as they do so. By the time the patron reaches the finish line 405, they may be traveling at a moderate rate of speed. The actual rate of speed of the patron may depend on several factors including, but not limited to: the difference in height between the landing 210 and the finish line 405; the combined weight of the patron and the vehicle 800 that he is driving; wind resistance; the physical characteristics of the vehicle 800 driven; the interaction between the vehicle 800 and the sloped section 300; whether or not the patron applied any braking force during the descent; and other factors. The goal of the race may be to see which patron can descend from the landing 210 to the finish line 405 the quickest. Various methods may be employed to do so.

The finish section 400 may generally comprise various materials, which may include plastic, metal, rubber, vinyl, PVC, nylon, or other suitable materials. The finish section 400 may comprise a fluid containing portion, which may be substantially surrounded by a protective layer. The protective layer may be more tough and abrasion resistance than other parts of the finish section 400, including the fluid containing portion. Different parts of the finish section 400 may be sewn, welded, glued, or otherwise attached in order to create the configuration desired. Different parts of the finish section 400 may be more prone to damage and thus may be configured differently. For instance, as a non-limiting example, portions of the floor 410 that may frequently contact the moving vehicle 800 may be reinforced in order to decrease the likelihood of puncture or other damage.

As with the other sections, different variations may be made to the finish section 400 in order to customize the race track 100. For instance, the width of the lanes 425 may be the same or different from the width of the lanes 340 in the sloped section 300. The lanes 425 may be wider or smaller depending on at least user and/or operator preference. The finish section 400 may comprise a divider 430 that generally separates the lanes 425 from each other. However, in some embodiments, the lanes 425 may not be separated. In some embodiments, the lanes 425 may not be separated because one or more grooves 435 are present in the floor 410 that may generally keep the vehicles 800 separated during use.

The height of the finish line 405 above the ground may vary as well. In some embodiments, the finish section 400 is substantially supported by the ground and the height of the patron above the ground when they cross the finish line 405 may be minimal. However, in other embodiments, the patron may be several feet above the ground when they cross the finish line 405. In some embodiments, the slope of the track 100 at the finish line 405 or in the finish section 400 may be generally horizontal, or it may be sloped downward away from the landing 210, or it may be sloped backwards in an upward direction. Different circumstances, contexts, and/or user or operator preferences may influence the slope of the track 100 at the finish section 400. In some embodiments, the finish section 400 comprises walls 415 that are located on two sides of the track 100. The walls 415 may be one to several feet high and may be several inches thick. The walls 415 may not be the same height throughout the length of the finish section 400. The finish section 400 may comprise inflatable poles, arches, or at least portions of a roof 420. In some embodiments, the finish section 400 comprises inflatable features that may be both decorative and functional.

In some embodiments the finish section 400 comprises an opening 440 in a wall 415 that allows patrons access to the track 100 and the floor 410. A gate (not shown) may be utilized to allow patrons onto the track 100 where they can obtain a vehicle 800 and move it to the top of the sloped section 300. The gate may comprise an opening 440 in the wall 415, and may comprise a separate feature that allows the opening 440 to be closed by a user or operator. A second gate may be present on the opposite side of the track 100 as well which may allow patrons to exit the track 100 area after use.

In some embodiments, a banner (not shown) or other generally flexible material may extend from one side of the floor 410 to the other, generally along the finish line 405. The banner may be easily detached from at least one side of the floor 410. The banner may be configured to break or tear somewhere between the two ends. Positioning a banner at the finish line 405 may be desirable as it may help indicate which patron has crossed the finish line 405 first. Additionally, some patrons may find extra enjoyment in breaking the banner as they cross the finish line 405.

The finish section 400 may also be augmented with a mechanical or electronic device (not shown) that may indicate which patron crossed the finish line 405 first. The device may also indicate the time it took for one or more patrons to descend down the sloped section 300. The times may be displayed locally in such a manner that the patrons or bystanders can see the results.

Stopping Section

As shown in FIGS. 1, 6, and 8, in some embodiments, the stopping section 500 may comprise a floor 505 and walls 510 and be connectable to at least the finish section 400. The floor 505 may be generally continuous from the finish section 400 and may allow patrons to drive a vehicle 800 through the finish section 400 and into the stopping section 500. The walls 510 in the stopping section 500 may be located on the sides of the floor 505 and may generally be designed to keep the patrons from unsafely exiting the stopping section 500. The stopping section 500 may also comprise an end wall 515, which may be used by the patrons to slow down and/or stop after the patron has completed his descent down the sloped section 300. The stopping section 500 may also comprise a viewing area 520 that is at the end of the track 100. The viewing area 520 may be used by spectators who wish to view the race from the end of the track 100. The viewing area 520 may be elevated above the ground and/or floor 505 of the stopping section 500, which may increase a spectator's viewing enjoyment. The viewing area 520 may comprise walls 525 that are generally designed to prevent the spectators from falling off or injuring themselves. A ramp 530 may be located adjacent the stopping section 500 to allow spectators up into the viewing area 520. The viewing area 520 may comprise netting, or other material, on one or more sides, including the ceiling or roof area.

In some embodiments the stopping section 500 may be generally used by patrons as an area in which they may decelerate their vehicle 800 and/or come to a stop. The end wall 515 may assist the patron by providing a surface against which the patron can impact to assist deceleration. In some embodiments, the end wall 515 may be inflated less than other portions of the track 100 in order to provide for a longer deceleration time, which may reduce the forces exerted on the patron's body. This may result in a safer deceleration experience. The walls 510 may be utilized to prevent the patron from bouncing off of the end wall 515 and out of the stopping section 500. In some embodiments, the walls 510 may be higher in height near the end wall 515 than they are nearest the finish section 400.

The stopping section 500 may generally comprise various materials, which may include plastic, metal, rubber, vinyl, PVC, nylon, or other suitable materials. The stopping section 500 may comprise a fluid containing portion, which may be partially or substantially surrounded by a protective layer, on at least one side. The protective layer may be more tough and abrasion resistant than other parts of the stopping section 500, including the fluid containing portion. Different parts of the stopping section 500 may be sewn, welded, glued, or otherwise attached in order to create the configuration desired. Different parts of the stopping section 500 may be more prone to damage and thus may be configured differently. For instance, as a non-limiting example, portions of the floor 505 or end wall 515 that may frequently contact the moving vehicle 800 may be reinforced in order to decrease the likelihood of puncture or other damage.

As with the other sections, different variations may be made to the stopping section 500 in order to customize the race track 100. For instance, the length of the stopping section 500 may be varied depending at least partially on the configuration of other parts of the track 100. If the patrons are traveling at a higher rate of speed when they cross the finish line 405, it may be advantageous to allow the patrons extra room in which to decelerate, thus reducing the forces exerted on the patron. Or, the stopping section 500 may be shortened due to space constraints or other considerations. In some embodiments, the floor 505 in the stopping section 500 may be negatively sloped, such that the floor 505 is sloped back towards the finish line 405. In such embodiments, a patron traveling through the finish line 405 and into the stopping section 500 may travel up the floor 505 in the stopping section 500, further decelerating his vehicle 800. The negative slope of the floor 505 may also be combined with a longer stopping section 500 to further aid in decelerating the vehicle.

Other materials and configurations may be employed in order to safely decelerate the vehicle 800 and the associated patron. For instance, as a non-limiting example, the end wall 515 may be replaced or augmented with netting (not shown) that further aids in decelerating the vehicle. Parts of one or more walls 510, 515 may comprise a cushion layer which may also aid in decelerating the vehicle. Foam or plastic, in large or small pieces, may be used in different configurations as well. Several different setups may be available that help the vehicle 800 decelerate and the scope of the invention is not limited in the type or style of deceleration methods employed.

The stopping section 500 may also comprise other walls, arches, a roof, or netting. A roof, part of a roof, or netting may be used keep patrons from exiting the stopping section 500 at the wrong time, or may be used to prevent other people and objects from entering the stopping section 500. Since patrons may be entering the stopping section 500 at a moderate rate of speed, it may be advantageous to keep unnecessary individuals out of the stopping section 500.

Some embodiments may employ a specific egress path in order to allow patrons to exit the track 100 area. For instance, a gap in the wall 510 may be used to direct patrons outward. Other methods may be used as well, including stairs or a ramp that goes up and over a wall 510, 515 or other part of the track 100.

Ground Layer

As shown in FIGS. 1 and 8, in some embodiments, a ground layer 600 may cover at least part of the ground or other surrounding area near the track 100. The ground layer 600 may be placed on the ground and be disposed between the ground and the track 100. Additionally, the ground layer 600 may extend to the side of the track 100 in order to cover at least some of the ground next to the track 100. The ground layer 600 may be placed on the ground, or it may be staked to the ground or otherwise attached to a portion of the ground. Alternatively, a heavy object may be placed on part of the ground layer 600 in order to prevent the ground layer 600 from substantially moving. In some embodiments, the ground layer 600 may be placed on the ground before at least part of the track 100 is inflated. After the ground layer 600 has been adequately positioned, parts of the track 100 may be inflated on or near the ground layer 600.

The ground layer 600 may comprise various materials including rubber, plastic, vinyl, nylon, PVC, etc. Parts of the ground layer 600 may comprise metal or plastics, such as any tie downs or connectors.

In some embodiments the ground layer 600 may be directly or indirectly connected to the inflatable segments of the track 100. For instance, ropes, cables, or elastic cords may be attached to the eyelets and tie downs disposed on the various parts of the inflatable segments. These may then be connected to the ground layer 600, to a heavy object placed on the ground layer 600, or to any stakes used to attach the ground layer 600 to the ground.

The ground layer 600 may be configured to serve various functions. In some embodiments, the ground layer 600 may be configured to provide a protective covering over the ground that prevents the ground around the track 100 from getting damaged by people walking near the track 100. In some embodiments, the ground layer 600 may protect at least part of the inflatable segments from becoming damaged due to objects located on the ground or the ground itself. For instance, the ground may contain sharp objects like glass or nails, or more natural objects like rocks that could cause harm to an inflatable object. A ground layer 600 may help prevent these or other objects from damaging the inflatable segments. The ground layer 600 may also comprise lines or figures, which may help direct patrons and/or spectators around the track 100. Or, the lines or figures may help the operators and installers correctly position the inflatable segments so that once inflated, the inflatable segments are located in the correct position. The ground layer 600 may also provide a more stable surface on which to walk. This may be true especially where the underlying ground comprises loose gravel or a slippery surface.

Inflation

In some embodiments, the track 100 contains one or more inflatable segments. Each inflatable segment may be inflated separately and then connected or attached to a second inflatable segment. This process may be repeated until the desired configuration is achieved. The inflatable segments may comprise a fluid containing portion, a protective cover, and/or sealable inlets and/or outlets 700. In some instances, portions of an inflatable segment may be used as both an inlet and an outlet. The inflatable segments may comprise an exhaust flap (not shown) that may be configured to allow the segments to be deflated more efficiently. The fluid containing portions may be generally fluid impermeable and may substantially retain fluid added to the inflatable segment. In some instances, the fluid used is atmospheric air or compressed air. Other gaseous fluids may also be suitable. Different portions of the inflatable segments may also be suitable to accept liquid fluids.

In order to inflate the inflatable segments, an air source may be connected to an inlet 700 in the inflatable segment. In some embodiments, the inlet 700 comprises a conduit 705 that connects the air source to the interior of the inflatable segment. The air source may comprise a fan, a compressed air source, or any other suitable air source that can adequately supply the interior of the inflatable segment with air. Air may be added to the inflatable segment until it is sufficiently full. The amount of air added to the segment may affect the physical properties of the sections. Different users or operators may wish to fill one or more of the inflatable segments up by different amounts and the amount by which one wishes to inflate the segments may depend on a variety of factors, which may include, but not be limited to: personal preference, desired softness of the inflatable segment, safety, stability, ability of the air source, etc. A method to inflate an inflatable segment may include the following steps: place one or more inflatable segments on the ground, a ground layer 600, or other suitable structure; connect an air source to an inlet 700 of the inflatable segment; inflate the inflatable segment to the desired fullness; disconnect the air source from the inflatable segment; close the air inlet 700 of the inflatable segment. These steps may be performed in this order or in a different order.

Vehicles

A variety of vehicles 800 may be used on the race track 100 and the scope of the invention is not limited by the type, style, or characteristics of the vehicles 800 described herein. In some embodiments, various soap box derby cars may be used, which may include any of the following: a baseboard, one or more axles, wheels, and a steering system. Other suitable vehicles 800 may omit one or more of these aspects. For instance, as a non-limiting example, any vehicle 800 with wheels may be suitable. Portions of the vehicles 800 may be inflatable as well. For instance, some vehicles 800 may have inflatable portions in place of walls, but still utilize any existing baseboards, axles, wheels, and steering system. Other vehicles 800 may be used and may be modified for the track 100. The configuration and components of a vehicle 800 to be used may depend on user preference, safety, operator preference, or other factors.

Vehicles 800 suitable for use on the track 100 may comprise other features that may be designed for specific purposes. For instance, as a non-limiting example, some vehicles 800 may be designed to substantially not leave the track 100 or the vehicle's lane 340, 425 during use as a safety precaution. Other vehicles 800 may comprise a speed limiting or braking device that may be employed before, during, or at the end of a race. Other vehicles 800 may be configured to limit the potential to roll over during use. Various other modifications may be made to a suitable vehicle 800 and the scope of the invention is not limited by the characteristics of the vehicles 800 used.

Other Aspects

An inflatable race track 100 may have advantages over conventional race tracks, which may make inflatable race tracks 100 more desirable for use. The characteristics described need not be present in all embodiments in order for an inflatable race track 100 to have advantages.

In some embodiments, the inflatable segments comprising the starting section 200 may make for a safer user experience due at least in part to the fact that they comprise inflatable aspects. For instance, as a non-limiting example, inflatable segments in the landing area 210 may be able to safely absorb impact energy from a patron were they to fall down or get pushed over while waiting at the landing 210. Other race tracks may not be equipped with such padded safety equipment to prevent such injuries.

In some embodiments, the fact that the walls 350, dividers 355, and/or floor 315 of the sloped section 300 are inflatable may make a safer track 100 on which a patron may race. A patron operating a vehicle 800 down the sloped section 300 may be at risk to tip over or crash during his ride. Having inflatable pieces throughout the sloped section 300 may make this portion of the race safer.

In some embodiments, the fact that the finish section 400 may comprise inflatable aspects may make this section of the race safer for patrons. For instance, as a non-limiting example, having one or more parts of the finish section 400 comprise inflatable pieces may provide some measure of safety if a patron were to crash or otherwise impact part of the finish section 400 during or after his race. Since the patron may be traveling at a moderate rate of speed by the time he reaches this point in the race, accidentally impacting part of the finish section 400 could potentially be harmful to the patron's health. However, since one or more inflatable pieces may be used in the finish section 400, a patron accidentally hitting an inflated piece at this point in the race may not be as dangerous as had he hit a more solid structure.

In some embodiments, an inflatable race track 100 may be safer than a conventional race track. Many surfaces for which a patron may contact may be flexible. For instance, as a non-limiting example, the stopping section 500 may comprise one or more inflatable segments. A patron traveling down the sloped section 300, through the finish section 400, and into the stopping section 500, may be traveling at a moderate rate of speed. The patron may contact one or more inflatable segments as a method of slowing down and stopping. An inflatable segment may absorb some of the kinetic energy of the patron. The kinetic energy may be dissipated throughout parts of the inflatable segment and more safely slow down the patron. The inflatable segment may be inflated to varying degrees, which may allow the user to customize the stopping section 500 to better ensure that the patron can end his race safely. In some embodiments, portions of the stopping section 500 may comprise a cushion layer, which may help slow down the patron.

The vehicles 800 may comprise inflatable portions, which may add a measure of safety because a patron crashing, or simply slowing down and stopping at the end of the race, may be more protected from injury if part of the vehicle 800 comprises one or more inflatable pieces.

Safety can also be increased by customizing the amount each inflatable segment is inflated. For instance, it may be desirable for some of the inflatable segments in the stopping section 500 to be less inflated than portions of the starting section 200. Because the inflatable segments can be inflated or deflated frequently, the energy absorbing characteristics of the inflatable segments can be customized and altered as needed.

An inflatable race track 100 may also be advantageous as it may provide a patron a unique user experience. For instance, as a non-limiting example, a sloped section 300 that is inflated may have a certain amount of flex or bounce. Putting weight on the floor 315 of the sloped section 300 may result in at least part of the floor 315 depressing. One may jump or lightly bounce on part of the floor 315, and the inflated floor 315 may exhibit some elastic properties by depressing, and then returning to the original position at the same time it applies an upward force on the user. A user bouncing on the floor 315 may be oscillating. The same may be true for a patron traveling down the sloped section 300 in a vehicle. If, during the run down the sloped section 300, the patron and his vehicle 800 push down on the floor 315, the floor 315 may depress, but then respond by returning to its original position at the same time it exerts an upward force on the patron. Adding this to the movement of the patron and the vehicle 800 traveling down the track 100 may result in a uniquely fun bouncing ride that cannot be easily replicated on non-inflatable race tracks.

In some embodiments an inflatable race track 100 may be more portable than a standard derby track and may be more easily moved. For instance, after the track 100 is finished being used, the user may simply deflate the track 100 and prepare it for transportation. The overall size of the deflated track 100 may be smaller than when it is inflated. Traditional derby tracks may not include inflatable segments and may comprise metal, plastic, wood, and other similar materials. These materials may not be configured to deflate, and thus the overall size of a traditional derby track and its components when being transported may be very similar to its size when fully assembled. The size of an inflatable track 100 may be greatly reduced by its ability to expend trapped air, which does not need to be transported. Only the physical parts of the track 100 may be transported, which does not include the air.

Additionally, some parts of the inflatable race track 100 derive at least part of their vertical and lateral stability from being inflated. Since the inflatable segments are configured in specific shapes, once they are filled with air, they may exhibit structural properties that allow them to remain upright. In some embodiments, some inflatable segments require few or no additional supports. In contrast to an inflatable track 100, traditional derby tracks often require substantial vertical supports in order to keep, the parts of the track up in the air. Instead of trapped air for vertical support, traditional derby tracks may use heavy metal scaffolding to support heavy wooden structures. By using trapped air to vertically support parts of the track 100, an inflatable race track 100 may be lighter overall given the decrease in the amount of vertical support needed.

An inflatable race track 100 may be modular and the inflatable segments may be replaceable for a variety of reasons. For instance, if one part of the inflatable track 100 becomes damaged, that section may be replaced with a similar section.

In some embodiments, a user may desire to replace a section even though that section is not damaged. For instance, a user may desire to use a sloped section 300 that has a different slope contour or profile. In order to substitute the second sloped section 300 for the original, the user may detach the original sloped section 300 from any adjacent sections, and replace it with the second sloped section 300. In this respect, the user may mix and match different sections together to create an inflatable race track 100 that suits his preference. Reasons for substituting one section for another may include, but not be limited to, the following: color of section, slope steepness, slope profile of section, lateral deviation of track 100, ability to resist lateral forces such as wind, etc.

Not all parts of the track 100 need to be inflatable in order to derive benefit from the inflatable portions. For instance, parts of the starting section 200 may comprise non-inflatable portions, while the sloped section 300, the finish section 400, and/or the stopping section 500 may comprise inflatable sections. In this configuration, the race track 100 may still derive benefit from some portions being inflatable. For instance, overall, the track 100 may still be lighter and easier to move; there may still be safety aspects that are superior to other styles of race track 100; and the ability to quickly customize different aspects of the track 100 may still be present. Other advantages of a race track 100 comprising some inflatable portions may exist.

TERMINOLOGY; ADDITIONAL EMBODIMENTS

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein. Additionally, a person having ordinary skill in the art will readily appreciate, the terms "upper" and "lower" are sometimes used for ease of describing the figures, and indicate relative positions corresponding to the orientation of the figure on a properly oriented page, and may not reflect the proper orientation of the device as implemented.

Certain features that are described in this specification in the context of separate implementations also can be implemented in combination in a single implementation. Conversely, various features that are described in the context of a single implementation also can be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example processes in the form of a flow diagram. However, other operations that are not depicted can be incorporated in the example processes that are schematically illustrated. Additionally, other implementations are within the scope of the following claims. In some cases, the actions recited in the claims can be performed in a different order and still achieve desirable results.

In describing the present technology, the following terminology may have been used: The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" means quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but also include individual values and sub-ranges within the indicated range. Thus, included in this numerical range are individual values such as 2, 3 and 4 and sub-ranges such as 1-3, 2-4 and 3-5, etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

It should be noted that various changes and modifications to the presently preferred embodiments described herein will be apparent to those skilled in the art. Such changes and modifications may be made without departing from the spirit and scope of the invention and without diminishing its attendant advantages. For instance, various components may be repositioned as desired. It is therefore intended that such changes and modifications be included within the scope of the invention. Moreover, not all of the features, aspects and advantages are necessarily required to practice the present invention. Accordingly, the scope of the present invention is intended to be defined only by the claims that follow.

What is claimed is:

1. A portable race course, comprising:

a base and a race surface, wherein said base is at least partially inflatable from a collapsed position to an inflated position;

wherein said race surface is inclined relative to horizontal;

wherein said race surface comprises at least one lane configured to receive a vehicle comprising wheels;

a plurality of guiding members, said guiding members comprise protrusions extending upwardly from said race surface and arranged along the periphery of at least a majority of the length of the lane;

wherein said race course is configured such that at least gravity causes said vehicle to accelerate down said race surface;

at least two soap box derby type of cars sized to fit a person;

a launch mechanism configured to assist said at least two soap box derby type of cars to start a race substantially simultaneously; and a pulling device that mechanically engages with the soap box derby type of car and pulls the car up the inclined race surface.

2. The portable race course of claim 1, wherein each lane has a starting point and an end point, said starting point being elevated higher than said end point, wherein the pulling device causes the car to travel from the end point to the starting point.

3. The race course of claim 2, wherein said guiding member is substantially parallel to at least one of said at least one lane.

4. The race course of claim 1, wherein each of said at least one lane comprises at least two guiding members.

5. The race course of claim 1, wherein said race surface further comprises two lanes.

6. The race course of claim 1, further comprising a plurality of inflatable segments configured to be temporarily connected together.

7. The race course of claim 6, wherein each of said plurality of inflatable segments comprises apertures configured to accept a binding device.

8. The race course of claim 7, wherein said binding device comprises an elastic cord.

9. The race course of claim 6, wherein at least two of said plurality of segments comprises at least one portion of a hook and loop closure system configured to temporarily connect said at least two of said plurality of segments together.

10. The race course of claim 1, wherein at least part of said race course is configured to attach to at least part of a second race course.

11. The race course of claim 1, further comprising a deceleration portion configured to decelerate a vehicle that has reached an end of said race course.

12. The race course of claim 11, wherein said deceleration portion is angled relative to a slope of said race surface.

13. The race course of claim 11, wherein said deceleration portion comprises a wall configured to limit the distance said vehicle may travel.

14. The race course of claim 1, wherein at least one of said at least one lane is configured to guide vehicles being transported to a beginning of said race surface.

15. A portable race course system, comprising:

a base, at least one wall, a race surface, and a racing vehicle sized to fit a person, wherein said base is at least partially inflatable from a collapsed position to an inflated position, wherein the base in the inflated position supports the racing vehicle in a manner such that the racing vehicle can race along the race surface;

wherein said race surface is configured to be inclined relative to horizontal;

wherein said race surface includes at least two lanes configured to receive said vehicle, wherein the two lanes are separated by a partition;

wherein said race course is configured such that at least gravity causes said vehicle to accelerate down said racing surface; and a pulling device that mechanically engages with the racing vehicle and pulls the racing vehicle up the incline of at least one of the lanes.

16. The race course system of claim 15, wherein said vehicle comprises at least one of: at least three wheels, four wheels, and a steering system.

17. The race course system of claim 15, wherein said vehicle is at least partially inflatable.

* * * * *